US005816201A

United States Patent [19]

Garvin

[11] Patent Number: 5,816,201

[45] Date of Patent: Oct. 6, 1998

[54] OFFSET CRANKSHAFT MECHANISM FOR AN INTERNAL COMBUSTION ENGINE

[76] Inventor: Edward A. Garvin, 205 Johnston St., Savannah, Ga. 31405-5606

[21] Appl. No.: 889,135

[22] Filed: Jul. 7, 1997

[51] Int. Cl.[6] ..... F02B 75/04

[52] U.S. Cl. ..... 123/53.1; 123/197.3

[58] Field of Search ..... 123/53.1, 197.3, 123/51 BB, 53.5, 197.4

[56] References Cited

U.S. PATENT DOCUMENTS

| | | | |
|---|---|---|---|
| 435,637 | 9/1890 | Winand et al. | 123/53.5 |
| 773,021 | 10/1904 | Lewis | 123/55.7 |
| 1,317,917 | 10/1919 | Freer | 123/53.1 |
| 1,515,946 | 11/1924 | Giles | 123/53.1 |
| 1,606,591 | 11/1926 | Müller . | |
| 1,956,804 | 5/1934 | Meyer . | |
| 3,633,429 | 1/1972 | Olson | 123/197.3 |
| 4,419,969 | 12/1983 | Bundrick, Jr. | 123/51 BB |
| 4,664,077 | 5/1987 | Kamimaru . | |
| 4,708,096 | 11/1987 | Mroz . | |
| 4,945,866 | 8/1990 | Chabot, Jr. . | |
| 4,974,554 | 12/1990 | Emery | 123/197.3 |
| 5,076,220 | 12/1991 | Evans et al. . | |
| 5,146,884 | 9/1992 | Merkel | 123/197.4 |
| 5,186,127 | 2/1993 | Cuatico . | |
| 5,297,448 | 3/1994 | Galvin . | |
| 5,544,627 | 8/1996 | Terziev et al. . | |

FOREIGN PATENT DOCUMENTS

| | | | |
|---|---|---|---|
| 06317178 A | 11/1994 | Japan | 123/53.1 |
| 2219345 (A) | 12/1989 | United Kingdom . | |

*Primary Examiner*—David A. Okonsky
*Attorney, Agent, or Firm*—Richard C. Litman

[57] ABSTRACT

An offset crankshaft mechanism for an internal combustion engine which allows for greater efficiency and increased torque. The invention includes an engine block, a crankcase, one or more piston cylinders each having a piston reciprocally disposed therein, a rotatable crankshaft longitudinally disposed within the crankcase and offset at a predetermined distance from the vertical axis of the piston cylinder, and one or more connecting rods connecting the pistons to the crankshaft. The offset crankshaft is located such that at a point during the power stroke the crankshaft is perpendicular to the vertical axis of the piston cylinder and the connecting rod is substantially collinear with the vertical axis of the piston cylinder. The crankshaft must be located far enough below the piston cylinders to prevent interference between the connecting rods and the piston cylinders. Long connecting rods are used to increase the efficiency of the engine by increasing the combustion chamber pressure at top dead center, and reducing the return stroke angle which reduces the friction between the pistons and the piston cylinders.

3 Claims, 2 Drawing Sheets

OFFSET CRANKSHAFT MECHANISM FOR AN INTERNAL COMBUSTION ENGINE

BACKGROUND OF THE INVENTION

1. Field of the Invention

The present invention relates to an improvement in the crankshaft mechanism of an internal combustion engine which allows for greater efficiency and increased torque. More specifically, the invention includes an offset crankshaft located such that, at a point during the power stroke, the crank of the crankshaft is perpendicular to the vertical axis of the piston cylinder, and the connecting rod is substantially collinear with the vertical axis of the piston cylinder. Interference between the connecting rods and the pistons is prevented by setting the crankshaft far enough below the piston cylinders to create a low return stroke angle.

2. Description of Related Art

Conventional internal combustion engines are built with the axis of the piston cylinder and the axis of rotation of the crankshaft sharing a common plane. Many attempts have been made over the years to increase the efficiency of the conventional engine design. One such attempt involves laterally offsetting the axis of rotation of the crankshaft from the axis of the piston cylinder. If the crankshaft is configured appropriately the engine may benefit through increased torque placed on the crankshaft as well as a reduction in frictional forces between the piston and the piston cylinder.

When the crankshaft is offset, one problem that results is that a conventional connecting rod will hit either the piston skirt or the bottom edge of the piston cylinder due to the increased angle between the connecting rod and the axis of the piston cylinder. It should also be noted that by increasing the length of the connecting rod the return stroke angle can be reduced, thereby decreasing the frictional forces between the pistons and the piston cylinders. Also by increasing the length of the connecting rod the dwell of the piston at top dead center can be increased, thereby increasing the combustion pressure generated in the combustion chamber at top dead center which increases the torque and horsepower output of the engine.

As can be seen in the following patents and patent applications, previous attempts to overcome the problem of interference between the connecting rod and the piston and piston cylinder and to maximize the benefits of the offset crankshaft have failed to yield satisfactory results.

U.S. Pat. No. 1,606,591, issued on Nov. 9, 1926, to Friedrick Müller describes an internal combustion engine design in which the cylinders are offset from the axis of the crankshaft to reduce the maximum lateral thrust in each unit, and the cranks of each unit are angularly displaced so that all of the piston forces reach a maximum at exactly the same instant. The overall result of such a design is to reduce the frictional losses on the pistons. The patent to Müller fails to maximize the torque exerted on the crankshaft and fails to describe the benefits of increasing the length of the connecting rod.

U.S. Pat. No. 1,956,804, issued on May 1, 1934, to Andre J. Meyer describes an engine design in which the crankshaft axis is offset to the opposite side of the longitudinal plane of the engine containing the valve shaft in order to allow a more compact engine design. U.S. Pat. No. 4,708,096, issued on Nov. 24, 1987, to Joseph Mroz describes an engine with a crankshaft that is offset from the center line of the power cylinder in a direction to increase the torque exerted on the crankshaft. U.S. Pat. No. 5,186,127, issued on Feb. 16, 1993, to Lorenzo Cuatico describes an engine with an offset crankshaft and a connecting rod with an offset journal pivotally secured to the piston which prevents the piston cylinder from interfering with the connecting rod during the return stroke. The above patents fail to teach maximizing the torque exerted on the crankshaft and fail to describe the benefits of increasing the length of the connecting rod.

U.S. Pat. No. 4,664,077, issued on May 12, 1987, to Shinji Kamimaru describes a reciprocating internal combustion engine having a head block axially slidably mounted in a bore formed in a cylinder block in alignment with the cylinder bore, and a cam for moving the head block in the bore in accordance with the position of the piston. The crankshaft of the engine is laterally offset from the axis of the cylinder bore by a length of the crank radius. The patent to Kamimaru fails to describe a simple crankshaft mechanism which maintains a small return stroke angle of the connecting rod to minimize the frictional forces between the pistons and the piston cylinders. The patent to Kamimaru also fails to describe the benefits of increasing the length of the connecting rod.

U.S. Pat. No. 5,076,220, issued on Dec. 31, 1991, to Hugh G. Evans et al. describes an internal combustion engine having a crankshaft which is offset from the central plane common to the longitudinal axes of the cylinders. The crankshaft is oriented such that, when the piston is at top dead center, the connecting rod and the cylinder axis form an angle of at least twelve degrees. The patent to Evans et al. fails to describe a crankshaft mechanism which maintains a small return stroke angle of the connecting rod to minimize the frictional forces between the pistons and the piston cylinders. The patent to Evans et al. also fails to describe the benefits of increasing the length of the connecting rod.

U.S. Pat. No. 5,297,448, issued on Mar. 29, 1994, to George F. Galvin describes a crank mechanism for an internal combustion engine includes a cylinder, a piston reciprocalable within the cylinder, and a rotatable shaft. The piston is in drivable connection with the shaft via a connecting rod, a slipper, and a torque lobe which is a circular plate eccentrically mounted on the shaft. The patent to Galvin fails to describe a crankshaft mechanism which maintains a small return stroke angle of the connecting rod to minimize the frictional forces between the pistons and the piston cylinders. The patent to Galvin also fails to describe the benefits of increasing the length of the connecting rod.

U.S. Pat. No. 5,544,627, issued on Aug. 13, 1996, to Nicola Terziev et al. describes an engine configuration in which the cylinder/piston assembly is inclined at an oblique angle relative to the center axis of rotation of the offset crankshaft and connected to the crankshaft with a curved or bow-shaped connecting rod. The patent to Terziev et al. fails to describe a crankshaft mechanism which maintains a small return stroke angle of the connecting rod to minimize the frictional forces between the pistons and the piston cylinders. The patent to Terziev et al. also fails to describe the benefits of increasing the length of the connecting rod.

U.S. Pat. No. 4,945,866, issued on Aug. 7, 1990, to Bertin R. Chabot, Jr. describes an internal combustion engine in which the center line of each cylinder is offset from the rotational axis of the crankshaft in the direction of rotation resulting in altered piston timing and the benefits thereof. United Kingdom Patent Application Number 2,219,345(A), published on Dec. 6, 1989, describes an offset engine crankshaft arrangement wherein the longitudinal plane of the connecting rod is substantially parallel with the longitudinal axis of the cylinder through the period about ninety degrees of crank movement after piston top dead center during the power phase of the engine cycle. The patent to Chabot, Jr. and the United Kingdom patent application fail to describe an engine design that effectively utilizes the benefits of increasing the length of the connecting rod and moving the crankshaft further away from the piston cylinder, thereby increasing combustion pressure at top dead center and reducing the return stroke angle of the connecting rod which will minimize the frictional forces between the pistons and the piston cylinders.

None of the above inventions and patents, taken either singularly or in combination, is seen to describe the instant invention as claimed. Thus an offset crankshaft mechanism for an internal combustion engine solving the aforementioned problems is desired.

SUMMARY OF THE INVENTION

The present invention relates to an improvement in the crankshaft mechanism of an internal combustion engine which allows for greater efficiency and increased torque. More specifically, the invention includes an engine block, a crankcase, one or more piston cylinders each having a piston reciprocally disposed therein, a rotatable crankshaft longitudinally disposed within the crankcase and being offset at a predetermined distance from the vertical axis of the piston cylinder, a crank, and one or more connecting rods connecting the pistons to the crankshaft. The offset crankshaft is located such that at a point during the power stroke the crank is perpendicular to the vertical axis of the piston cylinder and the connecting rod is substantially collinear with the vertical axis of the piston cylinder. The crankshaft must be located far enough below the piston cylinders and the connecting rods must be long enough to prevent interference between the connecting rods and the piston cylinders.

Accordingly, it is a principal object of the invention to provide an improved crankshaft mechanism for use in a variety of internal combustion engines which allows for greater efficiency and increased torque over conventional internal combustion engines.

It is another object of the invention to provide an offset crankshaft that is oriented such that at a point during the power stroke the crank is perpendicular to the vertical axis of the piston cylinder and the connecting rod is substantially collinear with the vertical axis of the piston cylinder, thereby maximizing the torque placed on the crankshaft.

It is a further object of the invention to provide a crankshaft mechanism which can maximize the torque placed on the crankshaft and prevent interference between the connecting rods and the pistons by setting the crankshaft far enough below the piston cylinders to create a low return stroke angle.

Another object of the invention is to provide a crankshaft mechanism designed to increase the efficiency of conventional internal combustion engines by using longer connecting rods which increases the dwell of the piston at top dead center, thereby increasing the combustion pressure generated in the combustion chamber at top dead center which increases the torque and horsepower output of the engine.

Still another object of the invention is to provide a crankshaft mechanism designed to increase the efficiency of conventional internal combustion engines by using longer connecting rods which reduces the friction between the pistons and the piston cylinders.

It is an object of the invention to provide improved elements and arrangements thereof in an offset crankshaft mechanism for an internal combustion engine for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
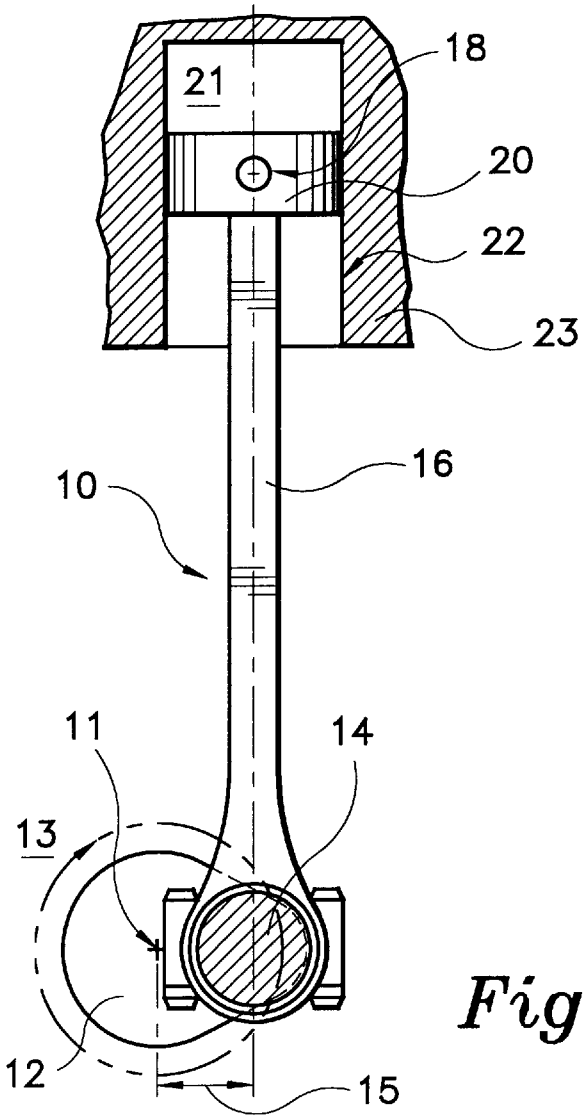
FIG. 1 is a diagrammatic, illustrative view of the offset crankshaft mechanism in an internal combustion engine showing the position of the connecting rod and crank during the power stroke of the piston.

The present invention relates to an offset crankshaft mechanism 10 for an internal combustion engine which includes a conventional engine block 23 and crankcase 13, one or more piston cylinders 22, a piston 20 reciprocally disposed in each piston cylinder, a rotatable crankshaft 11, and a connecting rod 16 connecting the piston 20 to the crank 12. In order to achieve the maximum torque output from the piston 20, the crankshaft 11 is offset a distance 15 such that the longitudinal axis of the connecting rod 16 becomes aligned with the vertical axis of the piston cylinder 22, and perpendicular to the crank 12 at a point during the power stroke, as shown in FIG. 1. The crankshaft 11 is also located far enough below the piston cylinder 22 to prevent interference between the connecting rod 16 and the piston cylinder 22, and the length of the connecting rod 16 is longer than a conventional connecting rod in order to decrease the frictional forces between the pistons 20 and the piston cylinders 22.

FIGS. 1 through 4 show the offset crankshaft mechanism 10 of the present invention being used in a simplified model of a conventional internal combustion engine. The details of the features of the engine are not important to the present invention; therefore, the present invention can be used in various types of diesel, gasoline, natural gas engines, as well as in engines using pressurized steam, air, or fluid. The focus of the present invention is on the configuration of the various features and the mechanical benefits that are derived therefrom.

The engine configuration used in FIGS. 1 through 4 has a crankcase 13 located below the engine block 23. A rotatable crankshaft 11 is longitudinally disposed within the crankcase and rotates about an axis. A piston cylinder 22 is provided in the engine block and a piston 20 is reciprocally disposed in the piston cylinder 22. The piston 20 is pivotally connected to the connecting rod 16 by wrist pin 18 and the connecting rod 16 is rotatably connected to the crank 12 by pin 14. The combustion chamber 21 is located between the top of the piston 20 and the piston cylinder 22. A typical gasoline powered engine would also include intake and exhaust valves (not shown) connected to the combustion chamber and a spark plug (not shown) to ignite the fuel.

However, it should be noted that this invention may also be used in two stroke engines, most of which do not include intake and exhaust valves.

FIG. 1 shows the axis of the crankshaft 11 offset a distance 15 such that the longitudinal axis of the connecting rod 16 is collinear with the vertical axis of the piston cylinder 22 and perpendicular to the crank 12 during the power stroke. The orientation of the connecting rod 16 and the crank 12 in FIG. 1 results in the largest possible torque being placed on the crankshaft 11 by the piston 20. The crankshaft 11 is offset to the left of the axis of the piston cylinder 22 so that when the crankshaft 11 rotates in a clockwise direction the connecting rod 16 will reach a vertical position on the power stroke.

Figure 2:
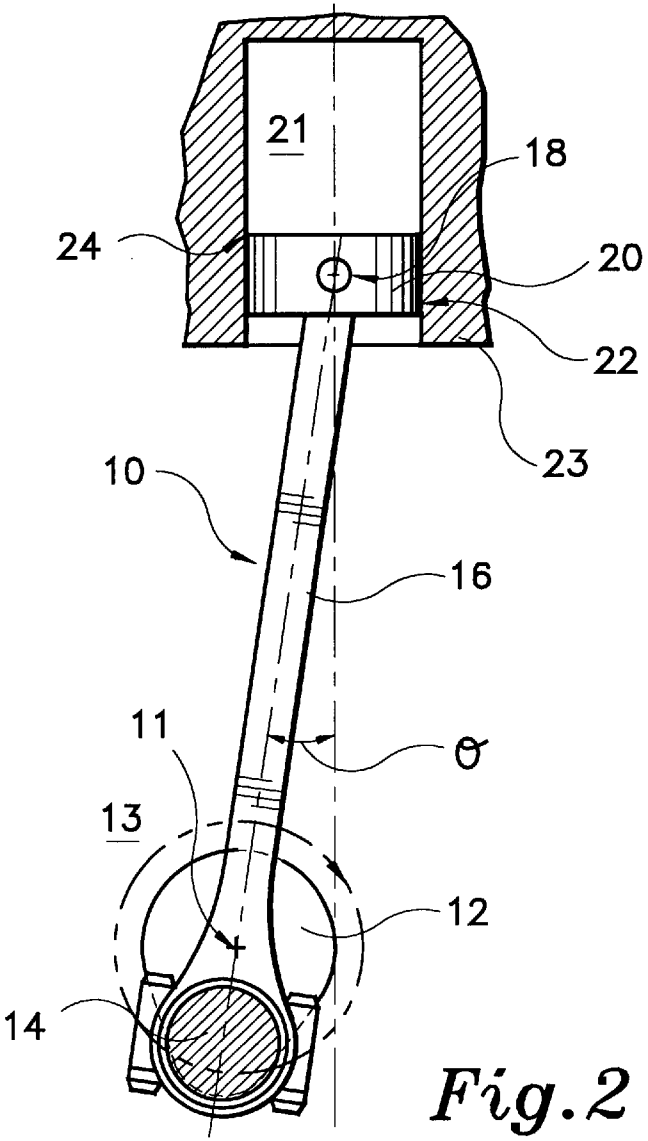
FIG. 2 a diagrammatic, illustrative view of the offset crankshaft mechanism in an internal combustion engine showing the piston at the bottom dead center position.
Figure 4:
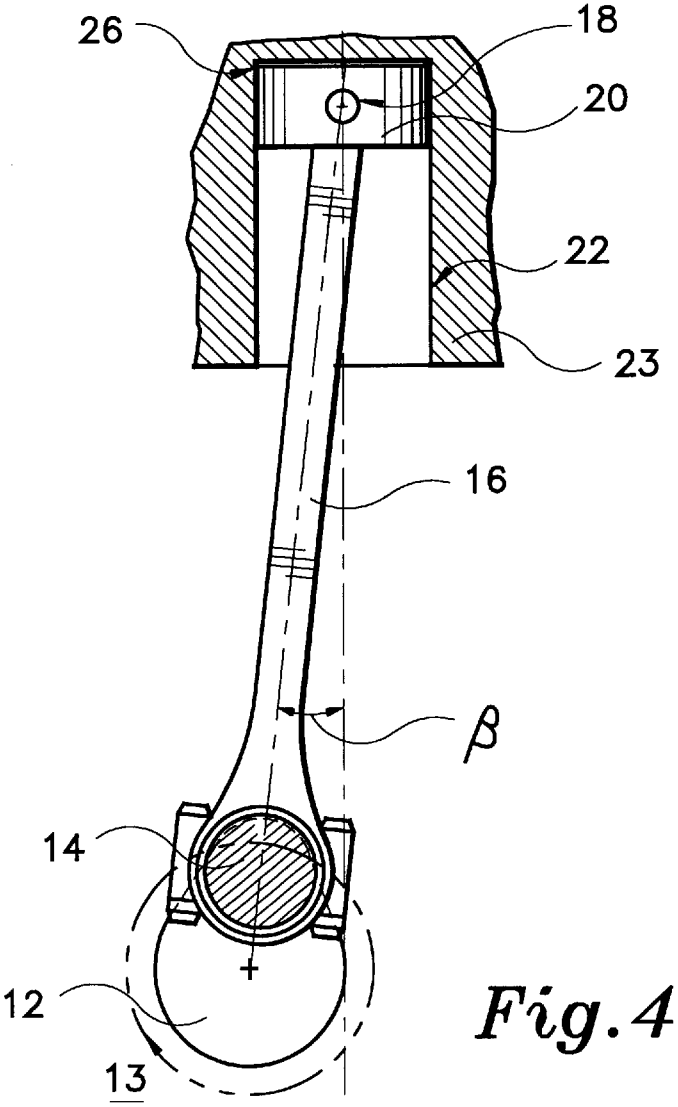
FIG. 4 a diagrammatic, illustrative view of the offset crankshaft mechanism in an internal combustion engine showing the piston at the top dead center position.

FIG. 2 shows the piston 20 at the bottom dead center position 24 and FIG. 4 shows the piston 20 at the top dead center position 26. The distance between point 24 and point 26 is called the stroke distance of the piston 20. The stroke distance and the diameter of the piston cylinder determine the amount of work that will be done on the piston 20 by the igniting fuel.

The distance between the axis of the crankshaft 11 and the axis of pin 14 is called the throw of the crank 12. When the axis of the crankshaft is located on the same plane as the axis of the piston cylinder, as it is in conventional engines, the stroke distance equals twice the throw of the crank. When the axis of the crankshaft 11 is offset from the axis of the piston cylinder 22, as it is in the present invention, the stroke distance is greater than twice the throw of the crank 12. For example, using the dimensions of the preferred embodiment, if the throw of the crank is 2.977 inches, the connecting rod is twenty-four inches in length and the offset is 2.977 inches, the stroke of the piston is 6.000 inches, rather than 5.953 inches as it would be in a conventional engine configuration. The extra stroke distance allows a more complete burning of the fuel and therefore the engine produces less pollution.

A number of other mechanical advantages are achieved by offsetting the crankshaft. Using the dimensions discussed above and assuming a constant angular velocity of the crankshaft 11, the speed of the power stroke is slower than the speed of the return stroke due to the geometric configuration of the offset. At top dead center the crank 12 is at an angle $\beta$, which equals 6.335 degrees as compared to the axis of the piston cylinder 22. At the bottom dead center the crank 12 is at an angle $\theta$, which equals 188.139 degrees as compared to the axis of the piston cylinder 22. In a conventional engine configuration the crank 12 would travel one hundred eighty degrees to the bottom dead center position but using the dimensions discussed above the crank 12 travels 181.805 degrees to the bottom dead center position 24.

If the return stroke is faster than the power stroke on a four cycle engine, the non-adiabatic compression on the return stroke should be higher then on a conventional four cycle engine. The resulting higher compression ratio would result in higher than normal air temperature which would result in a more effective combustion of the fuel and fewer pounds of fuel per brake horsepower hour in an engine using primarily compressed heated air to cause combustion, i.e. the diesel type. It should be noted that the present invention can be used in any two or four cycle reciprocation engine (or pump) that primarily turns in one direction.

Calculations have been made for an engine with a 5.5 inch bore, a 6.0 inch stroke, and a mechanical compression ratio of twenty to one at top dead center. The calculations for mechanical compression ratio were made without including the pressure of the firing of the fuel. The calculations show a quick reduction of the mechanical compression ratio after top dead center. For example, the mechanical compression ratio dropped from 20 to 1 at top dead center to 12.21 to 1 at a position twenty degrees from top dead center, and to 5.81 to 1 at a position forty degrees from top dead center.

Experiments have been performed on a diesel engine with an 8.0 inch bore and a 10.5 inch stroke with the engine running at a constant speed of 514 revolutions per minute. The experiments showed that pressure in the combustion chamber rapidly rises on the return stroke when the fuel is injected at 4.0 degrees before top dead center, then the fuel ignites and the pressure peaks and then begins to rapidly dip after top dead center as the fuel continues to burn and the area of the combustion chamber increases. Both the quick drop in the mechanical compression ratio and the rapid dip in combustion chamber pressure suggest that the offset configuration of the present invention is able to efficiently transfer the energy from the burning fuel to mechanical energy for use in turning the crankshaft 11.

Figure 3:
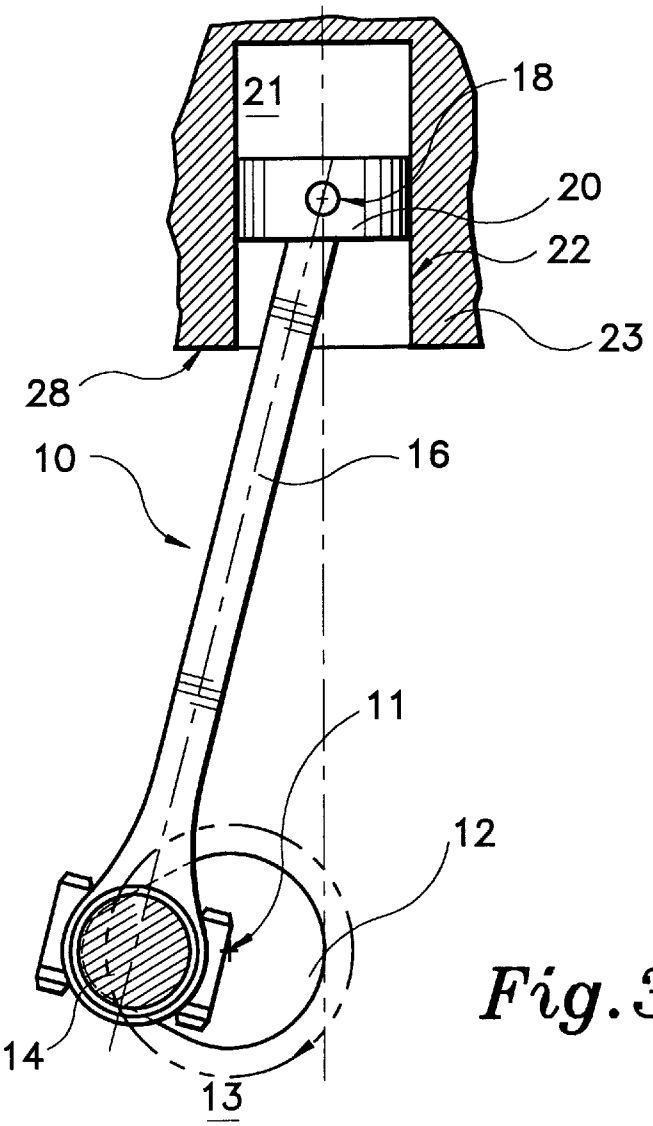
FIG. 3 a diagrammatic, illustrative view of the offset crankshaft mechanism in an internal combustion engine showing the position of the connecting rod and crank during the return stroke of the piston.

One problem that arises when the crankshaft 11 is offset is the potential that the piston cylinder 22 or piston skirt (not shown) will interfere with the connecting rod 16 on the return stroke at point 28 in FIG. 3. A second problem that offsetting the crankshaft 11 tends to create is that it increases the angle of the connecting rod 16 on the return stroke as compared to the axis of the piston cylinder which thereby increases the frictional forces between the piston 20 and the piston cylinder 22. The increase in friction can create excessive wear on the piston 20 and piston cylinder 22 and cause them both to fail prematurely.

The present invention solves these problems by orienting the crankshaft 11 well below the piston cylinder 22 and increasing the length of the connecting rod 16 while maintaining the crankshaft 11 at the same offset. The farther the crankshaft 11 is below the piston cylinder, the smaller the return stroke angle, which not only reduces the amount of friction between the piston 20 and the piston cylinder 22, but also lowers the chance of interference between the piston cylinder 22 and the connecting rod 16.

For comparison purposes, a conventional engine using a twelve inch long connecting rod and a crank with a three inch throw which is positioned on the axis of the piston cylinder will have the same maximum return stroke angle for the connecting rod as will a crank with a three inch throw and which has a three inch offset and a twenty-four inch connecting rod. But while the conventional engine has the same maximum angle on the power stroke as it does on the return stroke, the connecting rod in the offset configuration will never pass vertical during the power stroke. The offset configuration with longer connecting rods will reduce the overall friction between the pistons and the piston cylinders by reducing the average angle between the connecting rod and the axis of the piston cylinder.

The use of a relatively long connecting rod, as is disclosed in the present invention, has the added benefit of increasing the dwell of the piston at top dead center. The increased dwell at top dead center when the combustion chamber is at the smallest area will generate higher combustion pressure within the combustion chamber at top dead center if ignition of the fuel is properly started. The high combustion pressure will create more force on the piston which will therefore generate more torque and horsepower then is present in a conventional engine.

The crankshaft 11 should be located far enough below the piston cylinder 22 to prevent interference between the connecting rod 16 and the piston cylinder 22. The preferred length of the connecting rod 16 is about four times the stroke distance. In the preferred embodiment the vertical axis of the piston cylinder 22 and the connecting rod 16 form an angle β of about six degrees when the connecting rod 16 and the crank 12 are axially aligned and the piston 20 is in a top dead center position, as shown in FIG. 4.

The location of the crankshaft 11 in relation to the piston cylinder 22 may be varied upwardly or downwardly depending on the needs of the user. If the position of the crankshaft 11 is varied the length of the connecting rod 16, the amount of offset 15, and the throw of the should also be varied according to the preferred dimensions discussed in the previous paragraph. Factors that effect the user's decision include the potential interference between the piston cylinder 22 and the connecting rod 16, the frictional forces between the piston 20 and the piston cylinder 22 due to the angle of the connecting rod 16 on the return stroke, and the weight and size of the engine.

The configuration described in the present invention can also be used as a compressor mechanism if the crankshaft is rotated in a counterclockwise direction.

It is to be understood that the present invention is not limited to the embodiment described above, but encompasses any and all embodiments within the scope of the following claims.

I claim:

1. An offset crankshaft mechanism for an internal combustion engine comprising:

an engine block;

a crankcase located below said engine block;

a piston cylinder provided in said engine block, said piston cylinder having a vertical axis;

a piston reciprocally disposed in said piston cylinder, said piston having a predetermined stroke distance;

a rotatable crankshaft longitudinally disposed within said crankcase, said crankshaft being offset at a predetermined distance from the vertical axis of said piston cylinder;

a crank fixedly attached to said crankshaft, said crank extending in a direction perpendicular to said crankshaft; and a connecting rod connecting said piston to said crank, said connecting rod being four times as long as the stroke distance;

said offset being such that when said crank is perpendicular to said vertical axis of said piston cylinder then said connecting rod is collinear with said vertical axis of said piston cylinder.

2. The offset crankshaft mechanism for an internal combustion engine as defined in claim 1, wherein said offset is about three inches, said crank is about three inches, and said connecting rod is about twenty-four inches in length.

3. The offset crankshaft mechanism for an internal combustion engine as defined in claim 1, wherein said vertical axis of said piston cylinder and said connecting rod form an angle of about six degrees when said connecting rod and said crank are axially aligned, and said piston is in a top dead center position.

* * * * *